US011939841B2

(12) United States Patent
Henzler et al.

(10) Patent No.: US 11,939,841 B2
(45) Date of Patent: Mar. 26, 2024

(54) METHOD OF MAINTAINING CONSTANT AND ELEVATED FLOWLINE TEMPERATURE OF WELL

(71) Applicant: Great Basin Brine, LLC, The Woodlands, TX (US)

(72) Inventors: Stephen Henzler, The Woodlands, TX (US); Jacob Foster, Denver, CO (US); Ryan Riker, Tomball, TX (US)

(73) Assignee: Great Basin Brine, LLC, The Woodlands, TX (US)

( * ) Notice: Subject to any disclaimer, the term of this patent is extended or adjusted under 35 U.S.C. 154(b) by 82 days.

(21) Appl. No.: 17/464,431

(22) Filed: Sep. 1, 2021

(65) Prior Publication Data

US 2021/0396096 A1 Dec. 23, 2021

Related U.S. Application Data

(63) Continuation of application No. PCT/US2020/020712, filed on Mar. 2, 2020.

(60) Provisional application No. 62/812,862, filed on Mar. 1, 2019.

(51) Int. Cl.
*E21B 36/00* (2006.01)
*E21B 33/14* (2006.01)

(52) U.S. Cl.
CPC ..... *E21B 36/003* (2013.01); *E21B 33/14* (2013.01)

(58) Field of Classification Search
CPC ..... E21B 33/003
See application file for complete search history.

(56) References Cited

U.S. PATENT DOCUMENTS

| | | | | |
|---|---|---|---|---|
| 3,766,985 | A | 10/1973 | Willhite | |
| 3,831,678 | A * | 8/1974 | Mondshine | C09K 8/82 166/288 |
| 4,258,791 | A * | 3/1981 | Brandt | E21B 36/003 166/57 |
| 4,296,814 | A | 10/1981 | Stalder et al. | |
| 4,528,104 | A * | 7/1985 | House | E21B 36/003 507/926 |
| 5,016,716 | A | 5/1991 | Donovan et al. | |
| 2006/0211580 | A1 | 9/2006 | Wang et al. | |
| 2007/0284107 | A1 | 12/2007 | Crichlow | |
| 2010/0200237 | A1 | 8/2010 | Colgate et al. | |

(Continued)

FOREIGN PATENT DOCUMENTS

WO 2016058948 A1 4/2016

OTHER PUBLICATIONS

International Search Report and Written Opinion for International application No. PCT/US2020/020712.

*Primary Examiner* — William D Hutton, Jr.
*Assistant Examiner* — Avi T Skaist
(74) *Attorney, Agent, or Firm* — Jacob W Neu; Bradley Arant Boult Cummings, LLP

(57) ABSTRACT

Methods concerning the thermal insulation of oil and gas wells are disclosed herein. In some embodiments a thermal insulating fluid is inserted into the well completion sequence for thermally insulating a well at a desired depth to reduce paraffin and precipitate formation, improve oil flow rate, and reduce pressure build up in one or more annuli of the well. In other embodiments, the casing of a desired annulus in a completed well is perforated to permit a thermally insulating fluid to be pumped into the annulus and spotted at a desired depth.

11 Claims, 5 Drawing Sheets

(56) References Cited

U.S. PATENT DOCUMENTS

| | | | |
|---|---|---|---|
| 2013/0192834 | A1 | 8/2013 | Schneider |
| 2014/0158363 | A1 | 6/2014 | Deen |
| 2015/0198012 | A1 | 7/2015 | Mills et al. |

* cited by examiner

METHOD OF MAINTAINING CONSTANT AND ELEVATED FLOWLINE TEMPERATURE OF WELL

TECHNICAL FIELD

The present invention relates generally to drilling operations, and more particularly to methods for insulating completed wells used for the extraction of hydrocarbons.

BACKGROUND ART

During production operations and the extraction of oil and gas, heat may escape from the production tubing to outer annuli threatening wellbore integrity and production. During production the shallower and colder outer casing strings and annuli experience larger temperature changes in comparison with the inner casing strings and annuli.

A well-known problem in the industry is that the transfer of heat from the production tubing leads to the formation of gas hydrates and wax deposits within well bore annuli. These hydrocarbon solids, for example, paraffin and asphaltenes, precipitate and deposit into the annulus, thereby hindering or blocking the fluid flow path. This affects overall production and well integrity.

Paraffin precipitation and crystallization is caused by a loss in solubility related to changes in temperature, pressure, or composition of the production liquid, the most common reason being a decrease in temperature. Other factors such as flow rate can also affect wax deposition. Wax deposition increases as the flow rate decreases. This can create a cycle whereby cooler temperatures and lost pressure results in wax deposits, which slows the flow rate of the production liquid, which reduces the temperature further and creates more wax deposition, and so on.

Accordingly, inconsistency in flow has a major impact on total production. This problem is particularly severe in cold environments, for example, subsea wells and arctic production, where temperatures at the sea floor or in permafrost are very cold. Due to the low temperatures, heat transfer from the oil inside flow lines outward results in cooling and consequently to an increase in viscosity, resulting in a decrease in pumping efficiency.

Another challenge faced during oil recovery is annular pressure build-up. Trapped annular fluids expand when heated, thereby causing increased pressure on the casings surrounding the particular annulus. One of the most common causes for the collapse or burst of casing and tubing strings is heat transfer. Particularly in subsea formations, pressure buildup is generated by thermal expansion of the fluids trapped in casing annuli, commonly between the outer casing and production casing, or at the top of the cement and the wellhead or seal assembly. On land wells, relief valves alleviate pressure buildup. However, in deepwater wells such pressure relief valves are impracticable or simply do not work. Furthermore, the wellhead is at the bottom of the sea and there is no access to individual annuli.

In view of these concerns, insulating packer fluids have been used to control heat loss in oil or gas well construction operations. Packer fluids reduce the pressure differential between the inside of the tubing and the annulus, and between the outside of the casing and the annulus. In addition to controlling heat loss and reducing formation pressure, packer fluids prevent casing from corrosion or failure. The practice has been to pump insulating packer fluids into annular spaces during completion of a well as prevention or remediation for such concerns. A variety of insulating packer fluids have been developed for installation during completion operations as method of insulating a wellbore.

Such insulating packer fluids are used in areas subject to low ambient temperatures or having significant frost penetration (e.g., deepwater wells or arctic environments). These harsh environments introduce other costs and risk, such as their remoteness, high cost of transportation, and the research and development costs relating to the production of expensive and complex fluids with appropriate compositions to withstand the harsh conditions. Furthermore, such insulating packing fluids are less predictable in application.

In low temperature operations, warm production fluids rising to the surface of a well pipe become cooled by transferring heat to the permafrost or sea floor. Heat transfer from the production fluids outward results in precipitation and crystallization of paraffins and other solids within the production fluid. These deposits may freeze together blocking the production tubing. While steam or hot water may be pumped into the well to heat the fluids, this may also cause thermal expansion and an increase in pressure, threatening damage to the well casings. While insulating packing fluids may be used in these situations to protect the integrity of the well, as noted above, they are very expensive or difficult to control.

Thermal capping fluids, such as freeze-resistant diesel, are commonly added to a casing annulus last as freeze protection. Such hydrocarbon additives, often environmentally unsound, easily result in accidental spills due to their sequence placing and potential to spillover.

Furthermore, in many well construction operations, especially onshore wells, no production packer fluid is utilized.

Furthermore, in certain wells a section or interval of an annulus may be isolated from the rest of the well formation during completion. Typically, this is achieved by bringing the top of the cement column from the concentrically interior annulus closer to the surface, such that the top of the cement is inside the annulus above the concentrically exterior casing's casing shoe. A portion of the well may be isolated for a number of reasons, but isolation also blocks fluid access to the exterior geologic formation. Accordingly, when pressure builds up internally in the isolated portion, the pressure cannot be leaked off at the casing shoe into the geologic formation. That is, when the pressure internally exceeds the fracture gradient of the rock at the casing shoe, the rock may fracture, thus permitting fluid to disperse through the fracture and relieve pressure. Instead, any pressure buildup will be exerted on the casing, unless it can be bled off at the surface. Most land wells and some offshore platform wells are equipped with wellheads that provide access to every casing annulus and an observed pressure increase can be quickly bled off. On the other hand, most subsea wellhead installations do not provide access to the casing annuli and a sealed annulus may be created. Because the annulus is sealed, the internal pressure can increase significantly when there is an increase in temperature resulting from heat transfer from the production fluid.

Furthermore, in subsea operations, annuli become heated from the transfer of the temperature at the bottom of the wellbore and up the well as the fluids move through the pipe. The heated fluids trapped in the annulus expand and may also transfer heat to the casings, which expand and may lead to casing failure. For example, such thermal expansion may cause annular pressure build-up between the intermediate and production casings, leading to a collapse in the production string. Deepwater wells have no means to release pressures outside of the "A" annulus because seal sections are present in all casing hangar assemblies except the "A" annulus. The potential annular pressure buildup is significant when the annulus is sealed with no means for venting. Such annular pressure buildup threatens wellbore integrity. Annular pressure is created by thermal expansion when annular fluids are heated by production. Thermal expansion of the casing can break the bond between the casing and the cement, causing casing failure and leakage.

Accordingly, a method or process for thermally insulating a well during the process of well completion, and such a thermally insulated well, is desirable. Furthermore, a method or process for thermally insulating a completed well, and such a thermally insulated well, is also desirable.

SUMMARY OF THE INVENTION

The present disclosure concerns placing an insulating fluid during casing cementing operations, in one or more exterior annuli, resulting in the added benefit of controlling annular pressure build-up.

In some embodiments, the invention is directed to a method for insulating a well annulus during cementing, having the steps of forming a thermally insulating fluid having a hydrocarbon base fluid, and a thermally dependent viscosifying gel; and pumping the fluid down a string to a desired depth.

In some embodiments the invention is directed to a method for insulating a completed well having a first annulus and a second annulus disposed within the first annulus and separated from the first annulus by a casing, having the steps of identifying a hydrocarbon layer and a cement boundary in the first annulus; perforating the casing proximate to the cement boundary to create a perforation; draining the hydrocarbon layer through the perforation in the casing into the second annulus, and subsequently removing hydrocarbons from the well, thereby leaving a void in the first annulus; injecting a thermal insulating fluid into the void in the first annulus; draining the thermal insulating fluid through the perforation into the second annulus; and cementing the perforation.

DESCRIPTION OF THE INVENTION

Figure 1:
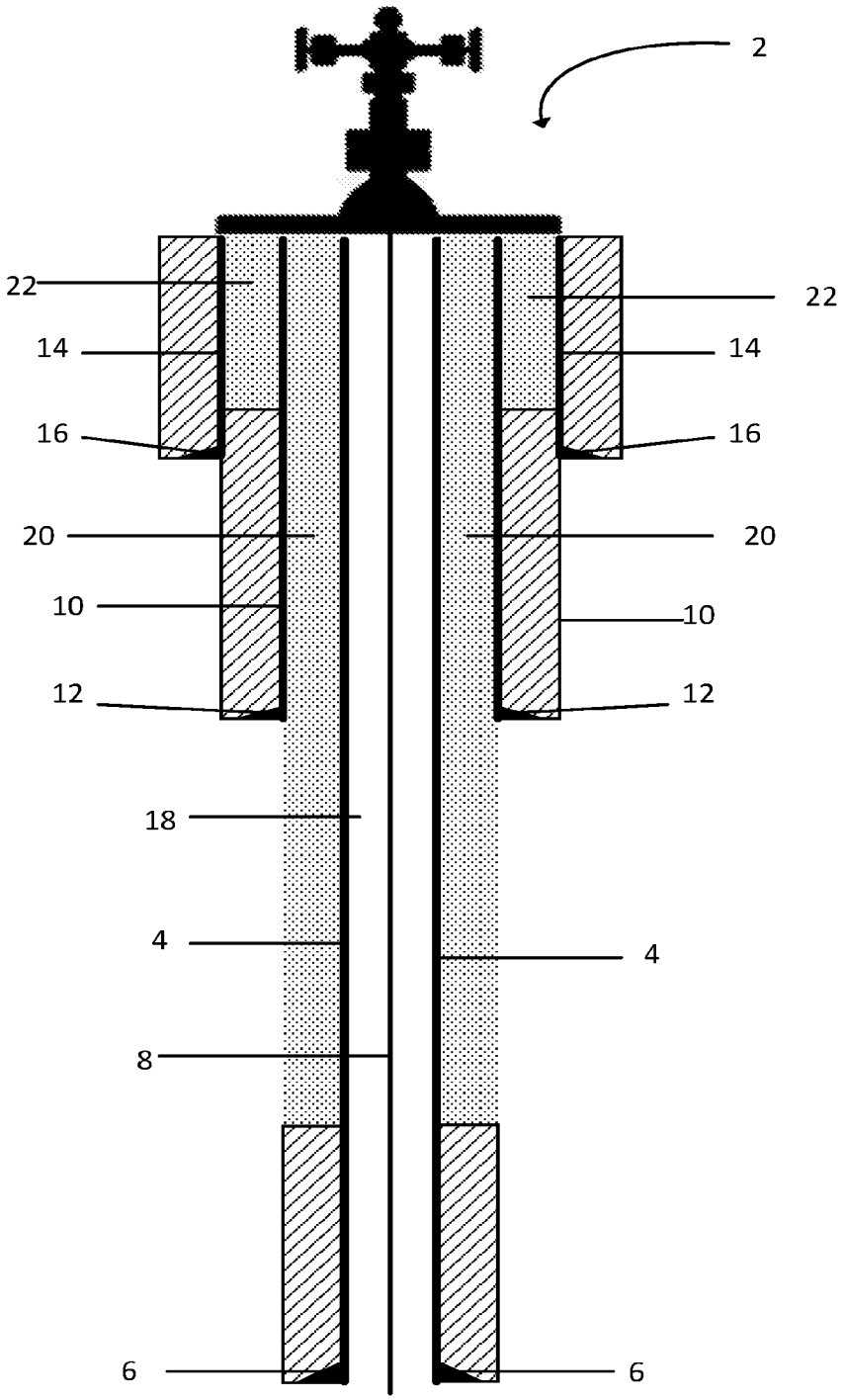
FIG. 1 is a schematic depiction of an oil and gas well.

Disclosed herein is a method for insulating a well during drilling or completion procedures, and for providing insulating fluid to a previously completed well.

Well Design

Constructing a well has several phases. First the well is drilled to a target depth. If it is determined that the well will be used for production, then portions of the well are cemented and completed. Following well completion, oil and gas production may commence.

To drill the well, a first section is drilled to a first target depth. Casing pipe is lowered into the first section and set into place with a cement mixture or slurry. The slurry is pumped into one or more annuli created by the space between the set casing and the geologic formation. This casing-cementing process is repeated until the target depth is reached. Multi-bore wells have two to five sets of bores concentrically arranged. Each concentrically interior bore has a smaller diameter than the bore concentrically exterior and adjacent to it. The bores are arranged such that the deepest bore has the smallest diameter and is set in the middle, with each successively concentrically exterior bore being wider and shallower. Thus, the diameter of a well formation decreases as the well is drilled deeper.

The outermost casing of the wellbore 2 is typically known as the surface casing 14 or conductor casing. The innermost casing is the production casing 4. In between the surface casing 14 or conductor casing and the production casing 4 may be one or more intermediate casings 10. Casing is pipe sized to be slightly smaller than the bored hole at a given depth and which is cemented in place. The casing provides structural integrity to a well and prevents collapsing of the hole. Casing also keeps fluids and gases in the well from seeping into the geologic formation, and vice versa.

Surface casing 14 runs from the surface of the well to some predetermined depth. Surface casing 14 serves as a conduit for drilling mud and permits the drilling mud to return to the surface as other drilling muds or fluids are pumped into the well.

Intermediate casing 10 may be provided at various radial intervals concentrically interior to the surface casing 14 and bored to a lower depth than the surface casing 14. Intermediate casing 10 provides structural integrity against internal or external pressures in the well and prevents the hole from caving. Intermediate casing 10 may also isolate zones within the well.

Production casing 4 is the innermost and deepest full string of casing pipe set within the well. It extends the full length of the wellbore 2. Because of this, production casing 4 may also be known as the "long string." Production casing 4 encases the oil and gas production equipment. The production casing 4 is the conduit from the surface of the well to the formation's final target depth. Placement of the production casing 4, and other production equipment, known as completion operations, signifies that a well is ready for production.

Tubing refers to moveable strings of pipe located within the bore or interior space of a casing.

The space between any two adjacent casings defines a casing annulus. Annular spaces are spaces through which fluid flows, for example, between the wellbore and casing or between casing and tubing. Casing assemblies comprising more than one casing string define one or more annular volumes between casing strings. Typically, during drilling operations each annular volume is filled, at least partially, with the fluid present in the wellbore when the casing string is installed.

Each wellbore annulus is bounded by the cemented or uncemented steel casings and/or tubing strings. Annuli are labeled starting from the inside to outside. The innermost annulus, the A annulus 18, is the annular space inside the production casing 4 and surrounding the production tubing 8 (which passes along, or substantially near and parallel to, the central axis of the well). All other annuli are referred to as outer or exterior annuli and proceed outward from the production tubing to the outermost casing. These annuli are conventionally identified alphabetically as the A annulus 18, B annulus 20, C annulus 22, etc.

FIG. 1 depicts a well arranged as described in the preceding paragraphs. The central bore of the well 2 is the production annulus or "A" annulus 18. In the middle of the A annulus 18 is the production tubing 8 (or "production string" or "long string"), through which oil is pumped to the surface. Surrounding the production tubing 8 and A annulus 18 is the production casing 4, which stabilizes and supports the wall of the well bore 2 to prevent a collapsed well at lower depths. The casing is lowered into the well open hole, anchored, and cemented in place. The production casing 4 is anchored by the production casing shoe 6.

Surrounding the A annulus 18 are one or more intermediate annuli. FIG. 1 depicts a single intermediate annulus identified as the "B" annulus 20. The B annulus 20 is surrounded by an intermediate casing 10 that stabilizes and supports the wall of the well bore 2 to prevent a collapsed well. The intermediate casing 10 is anchored by the intermediate casing shoe 12.

Surrounding the B annulus 20 and intermediate casing 10 (or, if more than one intermediate casing is used, all of the intermediate casings or annuli) is the surface annulus 22. FIG. 1 depicts the surface annulus 22 identified as the "C" annulus 22. The C annulus 22 also is surrounded by a surface casing 14 that stabilizes and supports the wall of the well bore to prevent a collapsed well. The surface casing 14 is anchored by the surface casing shoe 16. The surface casing 14 is typically the shallowest depth, but other shallow casings exterior to the surface casing may also be provided (e.g., a conductor casing). Such other casings are not depicted in FIG. 1.

During the course of drilling, various fluids are introduced. During drilling operations drilling fluid is circulated outside a casing (e.g., between the casing and a geologic formation). Drilling fluid may also be circulated into one or more annuli, preventing the casing from collapsing under pressure and acting as a drilling lubricant. Fluid washes and spacers are pumped ahead, and behind, of cement to segregate drilling fluid from cement and to remove or displace as much other drilling fluid as possible. The front spacer displaces mud and ensures no contamination of cement with mud. The spacer behind the cement displaces the cement into the annular space and ensures that there is no mixing of mud and cement. This process is known as displacement.

After the wellbore is drilled and casing-cementing operations are finished the well is ready to be completed. Completion refers to the process of transforming a well from drilling efforts to a production unit, including the installation of equipment to allow for production flow. Completion operations may be distinguished from drilling operations by the installation of production casing and production tubing. During well completion the drilling fluid present in the annuli is replaced by lighter completion fluid.

Typically during well completions, a packer is set between the tubing and the casing just above the production interval. The production interval, or completion interval, is the portion of the production casing that is prepared for production of oil and gas, such as by being perforated to permit the flow of oil into the production annulus. Packers protect the casing from pressure and corrosive fluids, and isolate production intervals and other treating fluids. Packer fluids have been used during completion operations to prevent the conditions created during production operations from threatening overall well integrity. Aqueous or non-aqueous hydrocarbon-based fluids, known as packer fluids, are placed into a casing annulus above a packer, where the packer has been placed to isolate production fluid from the casing annulus. Packer fluids fill the annular space up to the surface. Although the packer fluid may perform satisfactorily, the high cost of the components and high transportation costs associated with the low bulk density hollow shapes render it economically prohibitive.

Instead of or in combination with using a packer fluid as described in the preceding paragraph, a thermally insulating fluid may be emplaced in an annulus prior to installation of the production casing and/or tubing at at least some depth intervals in the well. Alternatively, the insulating fluid may be introduced after completion as further described below. If used during completion, the thermally insulating fluid may be introduced in place of a spacer fluid that would otherwise be pumped in the sequence through the well.

Thermally insulating fluids may be aqueous or non-aqueous. In some embodiments the insulating fluid may be an oil-based fluid such as diesel containing a polymeric viscosifier, such as polymeric gels that have a temperature-dependent viscosity. Other agents may included, such as additives that reduce the freezing point of the fluid. The insulating fluid may have low corrosivity. A preferred insulating fluid has a thermal conductivity between about 0.007-0.30 btu/(hr*ft*° F.) (or 0.012-0.52 W/(m*K)). A preferred insulating fluid is typically thin and pumpable at temperatures in excess of 130 degrees Fahrenheit (54 degrees Celsius). When pumped into place as further described below, the fluid cools and thickens along the exterior walls of the annulus to insulate colder geologic formations surrounding the well (e.g., as in deep-sea wells or wells located in arctic or subarctic regions) from the warm production tubing.

Application of Thermally Insulating Fluid During Production

Once a well has been drilled and it is determined to be appropriate for production of oil and gas, the well must be completed. Completion is the process of introducing the production tubing and cementing the casings in place. During cementing, multiple fluids are run in and out of the well in a sequence to prepare the well and set the cement. The operations fluids are typically separated in sequence by spacer fluids, which are inert fluids with low corrosivity such as clear brine.

According to an embodiment of the process, at least one instance of the spacer fluids in the cementing sequence may be replaced by a thermal insulating fluid. In this manner the thermal insulating fluid may be introduced to the desired annulus and spotted to the desired depth. In general, prior to cementing, the drilling fluids are flushed from the well to prevent mixing with the cement. A train of spacer fluids (typically 3 different fluids in sequence, but more or less may be used) follow the cement in the annulus to prevent mixing with drilling fluids above the cement. The thermal insulating fluid may be substituted in place of one or more of these spacer fluids.

Figure 2:
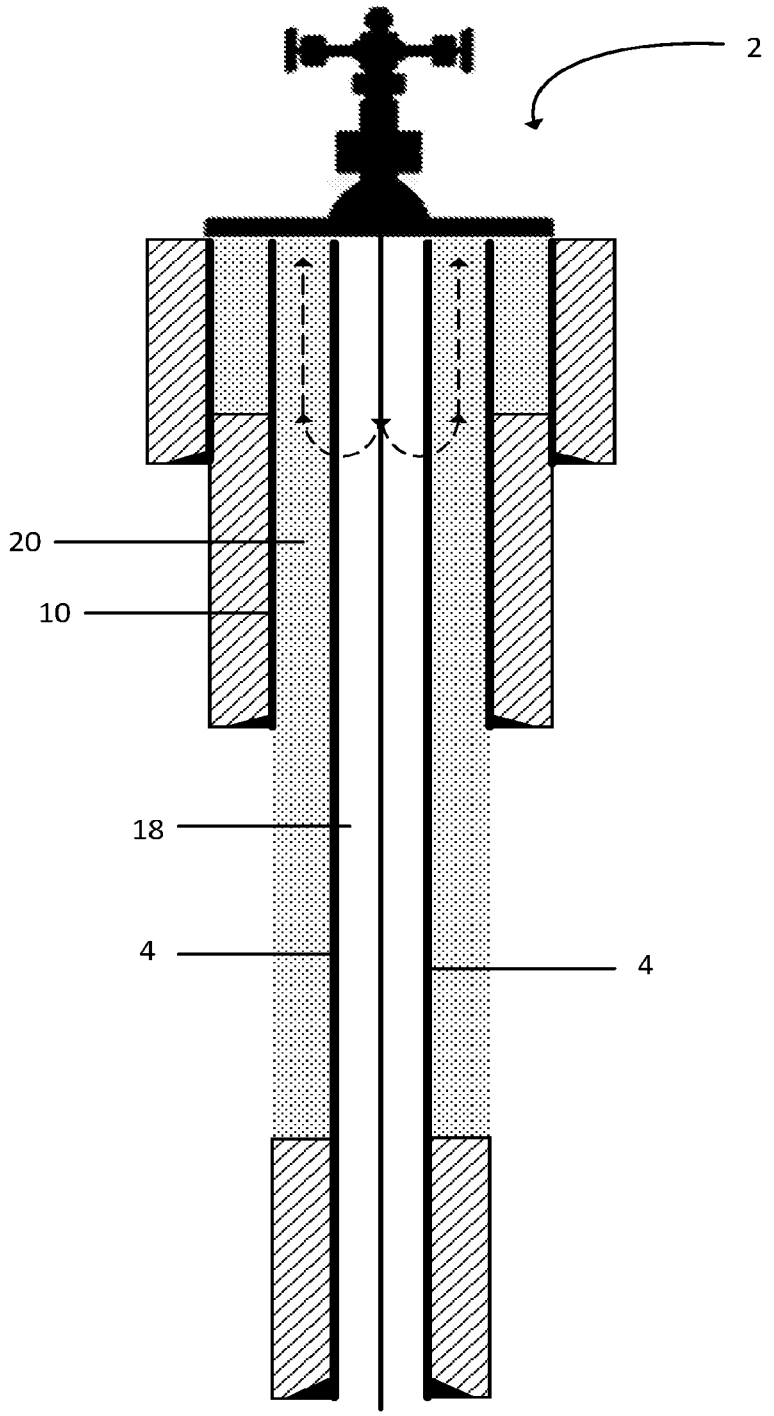
FIG. 2 is a schematic depiction of fluid flow for using a thermally insulating fluid in accordance with an embodiment of the invention for use during the cementing process of a well.

FIG. 2 depicts flow path of pumping thermal insulating fluid into the production casing 4 of the well 2. In this embodiment the thermal insulating fluid is pumped down the production casing string 4 or production annulus 18 and flows back up through the B annulus 20. The thermally insulating fluid is emplaced or spotted in the production casing at depths between surface and the depth of the surface casing (C annulus) shoe depth where thermal heat gradients are high and heat transfer from the production tubing 8 to the surrounding geologic formation is likely to be high.

Figure 3:
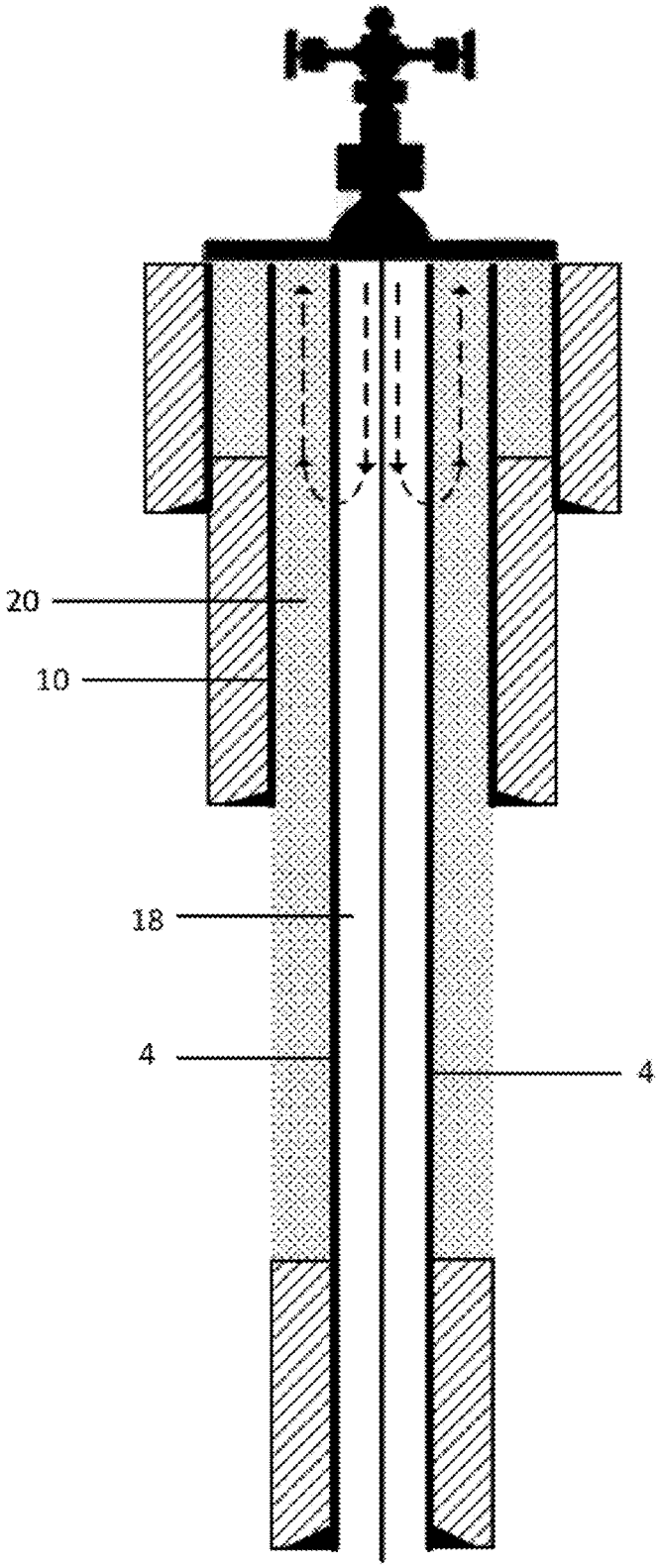
FIG. 3 is a schematic depiction of fluid flow for using a thermally insulating fluid in accordance with another embodiment of the invention for use during the cementing process of a well.

FIG. 3 depicts an example of pumping thermal insulating fluid into the intermediate casing or B annulus. The fluid is pumped down the production casing string 4 in the A annulus 18 and up the open hole portion of the B annulus 14 prior to cementing. The thermally insulating fluid is emplaced or spotted in the production casing at depths between surface and the depth of the surface casing (C annulus) shoe depth where thermal heat gradients are high and heat transfer from the production tubing 8 to the surrounding geologic formation is likely to be high.

Figure 4:
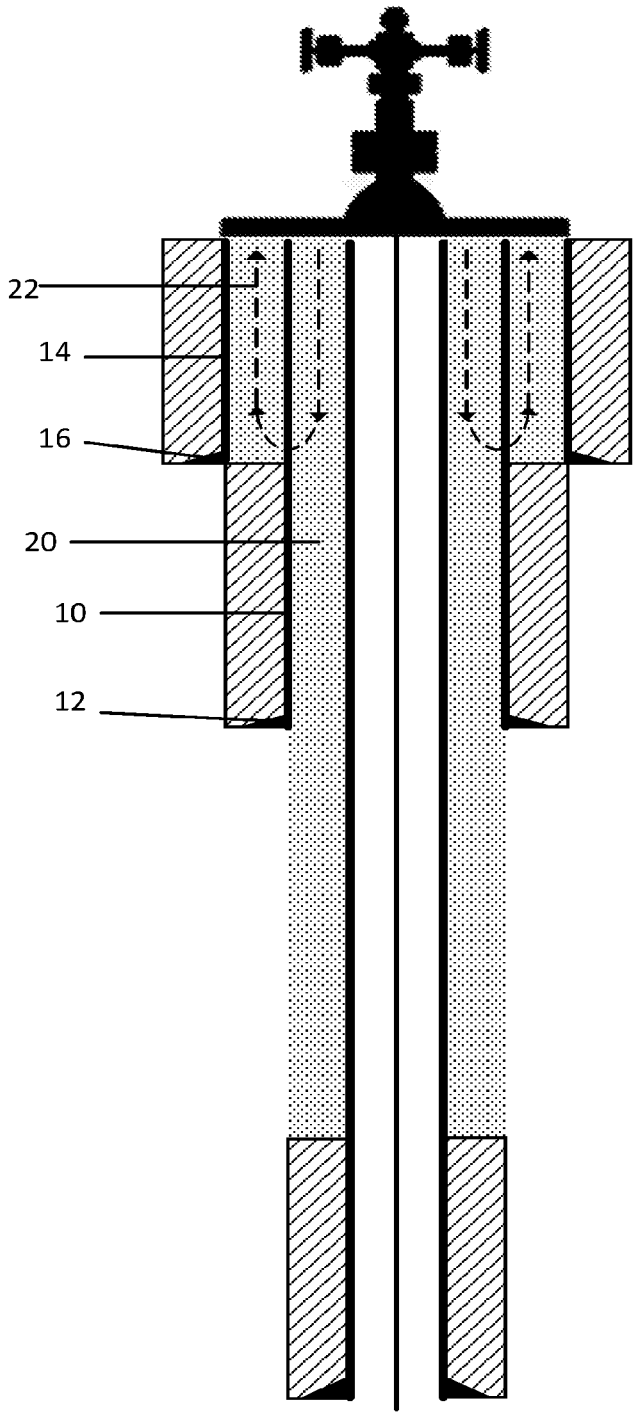
FIG. 4 is a schematic depiction of fluid flow for using a thermally insulating fluid in accordance with another embodiment of the invention for use during the cementing process of a well.

FIG. 4 depicts an example of pumping thermal insulating fluid into the intermediate casing 10 or B annulus 20 and into the surface casing 14 or C annulus 22. These are provided in separate cementing operations. The fluid is pumped down the casing string and up the open hole portion of the applicable annulus. The thermally insulating fluid is emplaced or spotted in the production casing at depths between surface and the depth of the surface casing (C annulus) shoe depth where thermal heat gradients are high and heat transfer from the production tubing 8 to the surrounding geologic formation is likely to be high.

Several advantages accrue from this method of thermally insulating a well prior to completion. Emplacing a thermally insulating fluid during the cementing fluid sequence introduces the thermal insulation protection at a time when the well may be particularly unstable due to thermal conductivity and serves to protect the well against damage caused by rapid thermal changes. In addition, by reducing heat transfer or loss through the sides of the well, the introduction of the thermally insulating fluid can reduce the accumulation of asphaltenes, paraffin, wax, tar, and gas hydrates, and thereby reduce costs associated with the chemical remediation or removal of such materials. This process may be used in connection with electronic submersible pumps and with pump jack completion wells.

Application of Thermally Insulated Fluid to a Completed Well

In a completed well and during production, at least a portion of the B annulus inside the annulus casing will have been blocked with cement 24 from the bottom up. While this is standard procedure for well production, it also blocks the ability to enter the A annulus deep underground. This becomes problematic when the production string becomes subject to thermal oscillations that inhibit production flow. In particular, the transfer of heat from the production tubing leads to the formation of gas hydrates and wax deposits within the annuli. These deposits may include, for example, paraffin and asphaltenes, precipitate and deposit, and can block the flow path of drilling muds or fluids, thereby affecting overall production and well integrity.

However, a thermal insulating fluid may be introduced into the space to reduce heat transfer into the annuli and to remove deposits present in the annuli.

First, the well operator should determine where paraffin and other deposits are present near or above the top of the cement 24 in the annulus closest to the production annulus (that is, the B annulus 20). As described above, paraffin and other precipitates typically form and are deposited in places where the surrounding geologic formation is significantly cooler than the production tubing, resulting in a high heat transfer gradient. If paraffin is present, the next step is to determine the depth of the top the cement 24. If paraffin is absent or not yet formed, then the depth of the top of the cement is typically known from the completion process.

Next, one or more holes 26 are punched into the casing 4 and/or string to perforate the casing 4 or string along the inner casing wall of the identified annulus at the depth of the top of the cement (which is also typically the lower bound of the accumulation of paraffin deposits). Once perforated, fluid may flow from the annulus having the deposits into the next inner annulus. In this example scenario, fluid may flow from the B annulus 20 into the A annulus 18.

In some embodiments there may be multiple perforations. For example, in some embodiments perforations may be located around the interior casing wall to increase and balance flow. In some embodiments the perforations may be spaced approximately 2-3 inches from each other. In some embodiments the perforations may be as large as approximately 2 inches in diameter. The number and size of perforations are primarily limited by the size of the holes that may be punched while maintaining the structural integrity of the casing wall. About 12 shots or punches per foot circumference provides a decent flow rate while not undermining the structural integrity of the casing.

When the casing 4 is perforated, the paraffin and other hydrocarbon deposits may be circulated through the perforations 26 and ultimately flushed out of the well. This leaves a void in the B annulus 20 that allows the injection of thermal insulating fluid into the void. The thermal insulating fluid enters the void in the B annulus 20, passes through the perforation 26, and enters the A annulus 18 surrounding the production string 8. The thermal insulating fluid is then spotted to a target depth 28 within the A annulus 18 using known techniques for removing drilling fluids and spotting spacer fluids or other fluids. The target depth 28 is selected based on the construction of the well, known flow rates through the production casing from historical well data, geologic formations, temperature and pressure data, etc.

Once the insulation fluid is spotted at the desired depth, the perforations in the casing are sealed off with cement. The well operator should then test the cement to confirm structural integrity.

Figure 5:
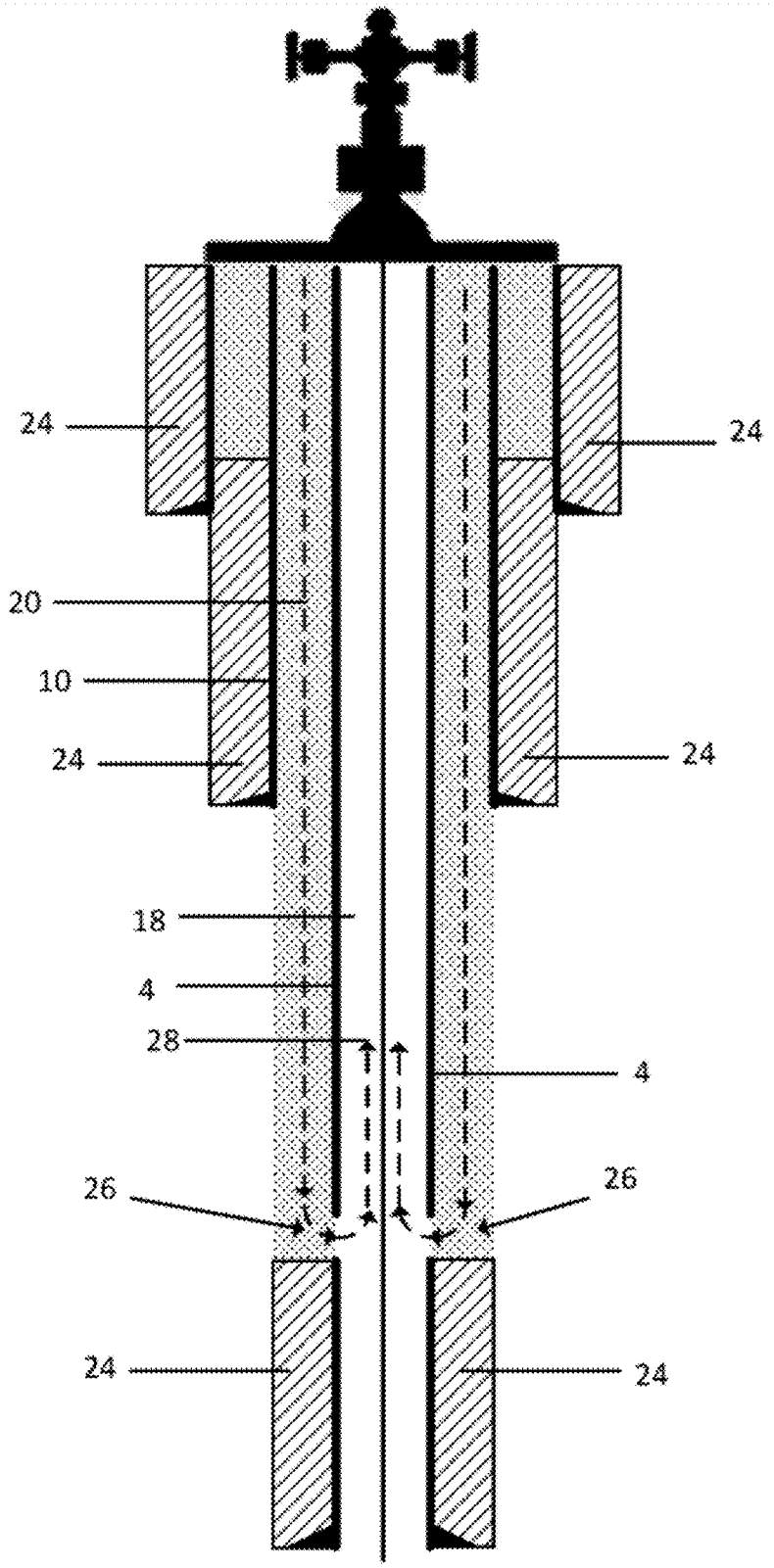
FIG. 5 is a schematic depiction of fluid flow for using a thermally insulating fluid in accordance with an embodiment of the invention for use in completed well.

FIG. 5 depicts the fluid flow in accordance with the above description.

The above description is particular to the insertion of thermal insulating fluid into the A annulus 18 from the B annulus 20. However, the same technique may be applied in relation to other annuli in the well (e.g., from the C annulus 22 to the B annulus 20, or from a surface annulus to an intermediate annulus, or from one intermediate annulus to a second intermediate annulus).

Several advantages accrue from this method of thermally insulating a completed well. One advantage is that thermal insulating fluid may be used to regulate the heat transfer to or from the production string. This promotes consistent production and well operations. Another advantage is that the thermal insulating fluid may be introduced into existing wells, rather than only being advantageous for new wells. Another advantage is that the procedure allows for the internal space of the annuli to be cleared of paraffin or hydrocarbon deposits. Other advantages may be apparent to persons skilled in the art.

We claim:

1. A method for insulating a well annulus during cementing of the annulus, wherein the well comprises a first annulus and a second annulus larger than and concentric to the first annulus, the method comprising:

flushing the first annulus and second annulus of drilling fluids;

forming a thermally insulating fluid having a hydrocarbon base fluid, and a thermally dependent viscosifying gel;

pumping a train of spacer fluids into the first annulus to a desired depth, the train of spacer fluids comprising the thermally insulating fluid;

passing the train of spacer fluids from the first annulus to the second annulus such that the thermally insulating fluid is spotted at the desired depth; and cementing the second annulus.

2. The method of claim 1 wherein the desired depth is equal to a depth of a surface casing shoe of the well.

3. The method of claim 1 wherein the first annulus is a production annulus.

4. The method of claim 1 wherein the first annulus is an intermediate annulus.

5. The method of claim 1 wherein the thermally insulating fluid has a viscosity at or about the viscosity of diesel when at an operating temperature of above 130 degrees Fahrenheit.

6. The method of claim 1 wherein the thermally insulating fluid has a thermal conductivity between about 0.007 and 0.30 BTU/(hr*ft*° F.).

7. A method for insulating a completed well having a first annulus and a second annulus disposed within the first annulus and separated from the first annulus by a casing, comprising:

identifying a hydrocarbon layer and a cement boundary in the first annulus;

perforating the casing proximate to the cement boundary to create a perforation;

draining the hydrocarbon layer through the perforation in the casing into the second annulus, and subsequently removing hydrocarbons from the well, thereby leaving a void in the first annulus;

injecting a thermal insulating fluid into the void in the first annulus;

draining the thermal insulating fluid through the perforation into the second annulus; and cementing the perforation.

8. The method of claim 7, wherein the first annulus is a production annulus.

9. The method of claim 8 wherein the second annulus is an intermediate annulus.

10. The method of claim 7 wherein the thermally insulating fluid has a viscosity at or about the viscosity of diesel when at an operating temperature of above 130 degrees Fahrenheit.

11. The method of claim 7 wherein the thermally insulating fluid has a thermal conductivity between about 0.007 and 0.30 BTU/(hr*ft*° F.).

* * * * *